United States Patent [19]

Chion et al.

[11] Patent Number: 4,681,595

[45] Date of Patent: Jul. 21, 1987

[54] PROCESS FOR DISPERSE DYEING DRY-SPUN ATACTIC POLYVINYL CHLORIDE-BASED FILAMENTS AND FIBRES AFTER DRAWING THE WET TOW

[75] Inventors: Pierre Chion, Bar-le-Duc; Jacques Menault, Charbonnieres-les-Bains, both of France

[73] Assignee: Rhovyl, Neuilly-sur-Seine, France

[21] Appl. No.: 843,603

[22] Filed: Mar. 25, 1986

[30] Foreign Application Priority Data

Mar. 26, 1985 [FR] France ..... 85 04618

[51] Int. Cl.[4] ..... D06B 3/04; D06P 1/16; D01F 6/10

[52] U.S. Cl. ..... 8/489; 8/494; 8/508; 8/538; 8/928

[58] Field of Search ..... 8/489, 494, 538

[56] References Cited

U.S. PATENT DOCUMENTS 3,533,729 10/1970 Mazzolini et al. ..... 8/538
4,591,361 5/1986 Cazzaro et al. ..... 8/538

*Primary Examiner*—A. Lionel Clingman
*Attorney, Agent, or Firm*—Stevens, Davis, Miller & Mosher

[57] ABSTRACT

The present invention relates to a process for continuous dyeing of filaments based on atactic polyvinyl chloride in the course of production.

It comprises, in succession, the phases of drawing, impregnation of the filaments by padding while, at the time of the impregnation, the filaments have a density of between 1.3 and 1.4 g/cm$^3$ (the filament roving having a water content of 10 to 30% by weight), of stabilization under tension in the presence of steam under pressure at a temperature between 100° and 130° C. for 2 to 20 seconds, and then oiling and shrinking in a known manner.

Dyeing carried out in this manner is quick and makes it possible to produce colors having good fastness.

2 Claims, No Drawings

PROCESS FOR DISPERSE DYEING DRY-SPUN ATACTIC POLYVINYL CHLORIDE-BASED FILAMENTS AND FIBRES AFTER DRAWING THE WET TOW

The present invention relates to a process for continuously dyeing filaments and fibres based on polyvinyl chloride during their production.

PVC-based fibres are valued in the textile sector because of certain special properties: nonflammability, light resistance, chemical inertness, and their ability to provide thermal, electrical and sound insulation.

Textiles based on polyvinyl chloride are usually coloured by dyeing in bulk during their production; however, while this process makes it possible to produce colours which have good fastness, any colour change produces constraints which make this process relatively uneconomical.

The fibres can also be dyed using an aqueous solution of dispersion or dyes, the most widely used dyes being disperse dyes and basic dyes. The dyes have no chemical affinity for the fibre, with the result that the dyed fibre consists of a solid solution of dye in the polymer. The dyeing process consists in producing this solution by placing the natural-coloured fibre in the presence of a solution or an aqueous dispersion of the dyes and in heating the whole to a temperature which makes it possible to speed up the rate of dye uptake without modifying the textile nature of the fibre.

Fibres made from atactic polyvinyl chloride are practically amorphous fibres, that is to say of very low crystallinity (which generally does not exceed 9%) which is that of the initial polymer.

As a result, a property of these fibres is that they shrink when subjected to a temperature above 100° C. and, while shrinking, they lose their mechanical properties: the strength drops and the elongation increases so that above 100° C. the processability of the said fibres becomes difficult or even impossible.

As a result of this, the processes for dyeing polyvinyl chloride-based fibres which are known at present do not exceed a temperature of 100° C. and require long dyeing times to compensate for the low temperature of fixing: the fibres can be dyed either in loose form or as tow, batchwise, and the dyeing operation then takes several hours. When they are in tow form, they can also be dyed continuously at temperatures of the order of 100° C., but residence times are long, so that rates of dyeing are low and the processes are costly.

It has now been found that it is possible to dye fibres based on atactic polyvinyl chloride, continuously, at elevated temperatures and very quickly, with good colour fastness.

More particularly, the present invention relates to a process for continuous dyeing of filaments based on atactic polyvinyl chloride, the filaments being drawn in one or more stages in a known manner and then being impregnated with a composition containing at least one plasto-soluble dye and being continuously stabilized, under tension, in the presence of steam under pressure, at a temperature between 100° and 130° C. for 2 to 20 seconds, the filaments being preferably subjected, at the time of impregnation, to a specific stress of between 0.05 and 0.35 g/dtex and having a density of between 1.3 and 1.4 g/cm$^3$.

Furthermore, at the time of impregnation, the tow of filaments contains from 10 to 30% of interstitial water.

In the present application, the expression "polyvinyl chloride" is understood to mean:

ordinary vinyl chloride homopolymer, which is predominantly atactic (that is to say produced by thermal polymerization) with a number-average molecular weight Mn of 50,000 to 120,000, preferably 60,000 to 90,000, and a second-order transition temperature Tg of 65° to 85° C., and an AFNOR index of approximately 120 (according to the Standard AFNOR T 51 013).

copolymers containing at least 85% by weight of vinyl chloride and up to 15% of a comonomer which is copolymerizable with vinyl chloride, such as vinyl acetate, vinyl and (meth)acrylic esters and ethers, acrylonitrile, olefins such as ethylene, and the like.

mixtures of polyvinyl chloride or a vinyl chloride copolymer as defined above with another polymer, so as to improve the characteristics of the articles produced (for example dye affinity or heat resistance).

Among these polymers, there can be mentioned cellulose esters, cyanoethylated cellulose, polyvinyl alcohol modified by ester sites, or cyanoethylated, polyacrylonitrile, chlorinated polyvinyl chloride whose second-order transition temperature is generally at least 100° C., with an AFNOR index of approximately 110, the atactic polyvinyl chloride or its copolymer being present in the mixture of polymers in a proportion of at least 75% and preferably 80%, but provided that the mixture of polymers which are obtained contains at least 75% or 80% by weight of predominantly atactic vinyl chloride units.

Within the scope of the present invention, vinyl chloride homopolymer is used in preference.

The filaments and fibres according to the present application are prepared according to the process known as dry spinning from solutions of polymer at a concentration which is generally between 20 and 30% by weight.

After the dry spinning, the filaments are drawn, to give them a molecular orientation and to improve their mechanical characteristics by a factor which is generally between 3 and 6×.

The drawing is preferably preceded by preheating of the filaments, for example in water at temperatures between 60° and 100° C., and more generally between 75° and 90° C.

The drawing as such can take place in one or two steps, but it is preferable to raise the temperature of the filaments gradually by preheating and then to carry out a first drawing in a heated bath maintained, for example, between 75° and 95° C., and a second drawing continuously at a slightly higher temperature than that of the first, preferably between 85° and 100° C., the overall draw ratio being preferably between 3 and 6×.

The impregnation treatment is carried out continuously immediately after the drawing.

It is generally carried out using the technique known as padding, by means of a composition containing at least one plastosoluble dye, but also, if appropriate, in the presence of adjuvants such as thickening, wetting, or acidifying agents, generally dispersed in demineralized water or any other suitable carrier.

The impregnation is generally carried out by means of a bath maintained between 60° and 90° C., preferably between 70° and 80° C.

It is also preferable to provide for several passes through the impregnating bath, from 1 to 3 in general.

The dye concentration is determined to produce the required shade, account being taken of a specified mangle expression which corresponds to the relationship:

$$E = \frac{\text{Weight of material after padding} - \text{weight of dry material}}{\text{Weight of dry material}} \times 100$$

The mangle expression is generally between 15 and 25% and corresponds to the quantity of bath absorbed by the filaments.

It has been found, surprisingly, that good shade fastness is obtained when, at the time of impregnation, the water content of the filament roving is between 10 and 30%, and preferably between 15 and 25% by weight, and when the filaments are subjected to a specific stress of between 0.05 and 0.35 g/dtex, the water present in the roving being interstitial water entrained during the drawing process.

On the other hand, at the time of impregnation, the filaments contain no swelling water, (that is to say they are substantially anhydrous), and have a density of between 1.3 and 1.4 g/cm$^3$, measured after freeze-drying at a temperature of the order of −15° C. at a pressure of 80 to 90 millitorrs, in the following manner:

Basis of the method

A first weight of the specimen is determined in air: M=vd (disregarding air pressure).

A second weight is determined after immersion in a silicone oil of density d':

$$M' = Vd - Vd'$$

This gives:

$$d = \frac{M}{M - M'} d'$$

Apparatus

Numbered specimen-carrier baskets.
Crystallizing dish, 20 cm in diameter.
Desiccator, 22 cm in diameter, with a tap.
Vacuum pump (capable of 1 mm Hg).
Balance, capable of weighing to 1/10, with provision for weighing from below.
15-den. nylon thread with a small hook.
Bath, thermostatted to within 1/10 of a degree, placed under the balance.
3-liter beaker.
Thermometer which can be read to within 1/10 of a degree.
Aluminium electrode (Messrs. F. C. Dannatt, 198, rue St-Jacques PARIS 5e), 6.25 mm in diameter by 15 cm in height, with a hole at one end.

Reactant

Silicone oil 47 V 50 (Rhône-Poulenc), approximately 5 liters.

Specimen

Variable weight of between 1 and 3 grams. (The accuracy will be proportionately better, the greater the weight).

Operating procedure: measurement as such

Tie the nylon thread attached to the balance hook so that it no longer touches the immersion liquid.
Zero the balance.
Weigh the specimen on the balance pan M.
Place it in a basket which has been calibrated beforehand by weighing in the oil at the test temperature - weight: m (tare).
Immerse the basket in the crystallizing dish containing the silicone oil.
Place the crystallizing dish in the desiccator which is then connected to the vacuum pump (at the beginning of the degassing, it is advisable to watch the operation closely: when the air in the specimen escapes too abruptly, there is a risk that it will pull the thread out of the basket or will give rise to intense boiling which could cause the oil to overflow from the crystallizing dish; should this happen, stop the pump for a moment or two and restart it when the boiling subsides).
Allow to degas for half an hour, making the desiccator vibrate during the last 10 minutes to facilitate the release of air.
Close the desiccator tap.
Stop and disconnect the vacuum pump.
Release the vacuum inside the desiccator very slowly.
Transfer the specimen-carrier baskets quickly into the thermostatted oil bath.
Allow the temperature to stabilize for approximately 6 hours (this time depends on the external temperature and on the number of specimens).
The temperature should be controlled to within 1/10 of a degree.
Untie the nylon thread and dip the little hook in the oil.
Zero the balance.
Attach the basket to the hook, being careful not to take it out of the liquid (use another hook with a long rigid rod for this purpose).
Determine the weight: m', from which the weight M' of the immersed specimen will be deduced:

$$M' = m' - m$$

Expression of the result: Density $$d = \frac{M}{M - M'} d'$$

d' being the density of the silicone oil at the test temperature, the silicone oil having been standardized beforehand.

After the impregnation phase, carried out under the conditions described above, the filaments are subjected to a continuous stabilization treatment to prevent the residual shrinkage of the filaments, in the presence of steam, and under tension, at a temperature between 100° and 130° C, preferably between 105° and 115° C., for a period of between 2 and 20 seconds, preferably between 5 and 15 seconds. The shrinkage stabilization treatment enables the dyes taken up on the fibre to be satisfactorily fixed.

It is quite surprising that a shrinkage stabilization period as short as this also permits the dye to be properly fixed.

The filaments leaving the fixing apparatus are generally oiled before being subjected, preferably, continuously, to a free shrinking which can be carried out in boiling water for a period which can vary, for example at least 10 minutes, generally 10 to 20 minutes or even longer, or in saturated steam, for example by being passed through a nozzle such as described in French Pat. No. 83 329/1,289,491. In such a nozzle, the filaments are treated with saturated steam at a temperature between 105° and 130° C. and are simultaneously shrunk and crimped, which permits better textile processability afterwards. Similarly, when the shrinkage is carried out in boiling water, it is preferably preceded by mechanical crimping.

Such a process can be carried out continuously up to the shrinkage phase, which permits it to be used with ease industrially, and which is of major economic interest, especially since, on an industrial scale, the process according to the invention can be applied to tows comprising a very large number of filaments derived from several spinning cells, to produce tows consisting of at least 100,000 filaments, and capable of going up to 1 million filaments or even more.

The fastness of the shades to washing is determined according to ISO Standard 105-E-01, to sweat according to ISO Standard 105-E-04 and to light according to ISO Standard 105-B-01.

EXAMPLE 1

A solution of atactic polyvinyl chloride (AFNOR index 120, chlorine content 56.5%) in a carbon disulphide/acetone mixture, 50/50 by volume, is prepared, the concentration of polymer being 28%.

The solution, maintained at 70° C., is dry-spun in a known manner and the filaments are then preheated in a water bath maintained at 80° C., are drawn a first time to a ratio of 3.3× in a bath maintained at 80° C., drawn again to a ratio of 1.35× in a second bath maintained at 97° C., the overall draw ratio being 4.45×. The drawing exit speed is then 110 m/min.

The filaments have a density of 1.3 g/cm$^3$ and the filament roving contains 18% water. The filaments, maintained under a stress of 0.15 g/dtex, are then impregnated continuously with a dyeing composition maintained at 80° C. and having the following formulation:

100 g/l of plastosoluble dye (CI Disperse Red 4),
2 g/l of a wetting agent of the sulphonated polyglycol ether type, known under the trademark "Uniperol W" (BASF),
2 g/l of a dispersing agent: mixture of solvent and an anionic fatty acid derivative known under the trademark Silvatol 1 (Ciba),
10 g/l of a thickener of the esterified polyacrylonitrile type, known under the trademark Solidokoll K (Hoechst),
1 cc/l of acetic acid,
demineralized water to make up to 100%,
pH of the composition 4–5,
the mangle expression is 20%,
the filaments are then stabilized continuously under tension (a stress of 0.15 g/dtex) in the presence of steam under pressure at a temperature of 120° C. for 3 seconds, and are then oiled, subjected to a shrinkage in a free state in a boiling water bath for 20 minutes and are then crimped mechanically in a known manner. The colour yield (proportion of dye fixed relative to the proportion of dye impregnating the fibre) is 98% and the fastness of the shades to washing (according to ISO Standard 105-E-01) at 60° C. is 5 and the fastness to light, measured in the Xenotest is 4–5 (360 h at 20° and 70% RH), according to ISO Standard 105-B-01.

EXAMPLE 2

A solution of polyvinyl chloride of an AFNOR index of 120 and a chlorine content of 56.5% and of chlorinated polyvinyl chloride with a chlorine content of 67.5% is prepared, in a solvent mixture of carbon disulphide and acetone, 50/50 by volume. The ratio of the weight of chlorinated polyvinyl chloride relative to the total weight of polymer is 0.15.

The solution, which has a polymer concentration of 27% is filtered and then dry-spun at the temperature of 70° C.

The spun tow of 850,000 filaments, each of 14 dtex, is heated to a temperature of 85° C. in a hot waterbath under a stress of 0.065 g/dtex, and then drawn a first time in hot water at 87° C. to a ratio of 6.0× at a speed of 102 m/min under a stress of 0.35 g/dtex.

On leaving the drawing, it contains 19% of water and the fibre density is 1.350 g/cm$^3$.

It is impregnated with a composition of the following composition, maintained at approximately 70° C., at a speed of 102 m/mIn under a stress of 0.20 g/dtex:

85 g/l of plastosoluble dye "CI Disperse Orange 30"
2 g/l of a wetting agent of the sulphonated polyglycol ether type known under the trademark "Uniperol W" (BASF)
10 g/l of a thickening agent of the esterified polyacrylonitrile type, known under the trademark Solidokoll K (Hoechst)
2 g/l of a dispersing agent: mixture of solvent and an anionic fatty acid derivative known under the trademark Silvatol 1 (Ciba)
1 cc/l of acetic acid
pH of the composition 4–5
temperature of the composition = 65° C.
colour yield: 90%
padder mangle expression: 20%
dye concentration: 1.5% of "CI Disperse Orange 30".

It is treated in a steam tube at a temperature of 126° C. for 2.7 seconds, under a stress of 0.20 g/dtex, and it is then oiled and shrunk continuously by being passed through a nozzle supplied with steam at 105° C., and is crimped and then dried; a final gauge of 3.4 dtex is obtained.

Various colour fastness values are measured:
to light: 4–5
to washing: 5–6
to sweat: 4–5.

What is claimed is:

1. In a process for continuously dyeing filaments based on atactic polyvinyl chloride, which filaments are obtained by dry spinning, then drawing in at least one phase, oiled, and shrunk in an aqueous medium, the improvement comprising impregnating the filaments, after drawing, with a dyestuff maintained at a temperature of between 60° and 90° C. and containing at least one plastosoluble dye, the filaments having, at the time of the impregnation, a density of between 1.3 and 1.4 g/cm$^3$, with the filaments formed into a tow then containing from about 10 to about 30% by weight of water, the filaments being subjected to a stress of 0.05 to 0.35 g/tex of the time of the impregnation, and thereafter stabilizing the filaments under tension, in the presence of stream, under pressure, at a temperature of between 100° and 130° C. for 2 to 20 seconds.

2. The process according to claim 1, wherein the filaments are stabilized at a temperature of between 115° and 125° C. for 5 to 15 seconds.

* * * * *